US006155334A

United States Patent [19]

Steele

[11] Patent Number: 6,155,334

[45] Date of Patent: Dec. 5, 2000

[54] ROTARY HEAT EXCHANGE WHEEL

[75] Inventor: Donald F. Steele, Cohasset, Mass.

[73] Assignee: AirXchange, Inc., Rockland, Mass.

[21] Appl. No.: 09/367,805

[22] PCT Filed: Jan. 6, 1999

[86] PCT No.: PCT/US99/00138

§ 371 Date: Nov. 2, 1999

§ 102(e) Date: Nov. 2, 1999

[87] PCT Pub. No.: WO99/35442

PCT Pub. Date: Jul. 15, 1999

Related U.S. Application Data

[63] Continuation-in-part of application No. 09/003,237, Jan. 6, 1998, abandoned.

[51] Int. Cl.[7] ..... F23L 15/02

[52] U.S. Cl. ..... 165/8; 165/10

[58] Field of Search ..... 165/4, 6, 8, 9, 165/10

[56] References Cited

U.S. PATENT DOCUMENTS

| | | | |
|---|---|---|---|
| Re. 35,235 | 5/1996 | Beckerman | 62/77 |
| 3,181,602 | 5/1965 | Johnstone | 165/4 |
| 3,789,916 | 2/1974 | Lindahl . | |
| 4,093,435 | 6/1978 | Marron et al. | 55/269 |
| 4,432,409 | 2/1984 | Steele | 165/8 |
| 4,594,860 | 6/1986 | Coellner et al. | 62/271 |
| 4,773,145 | 9/1988 | Baker et al. | 29/157.3 |
| 4,825,936 | 5/1989 | Hoagland et al. | 165/8 |
| 4,875,520 | 10/1989 | Steele et al. | 165/10 |
| 4,924,934 | 5/1990 | Steele | 165/8 |
| 4,960,166 | 10/1990 | Hirt | 165/9 |
| 5,276,392 | 1/1994 | Beckerman | 318/751 |
| 5,307,643 | 5/1994 | Beckerman | 62/77 |
| 5,485,877 | 1/1996 | Brophy | 165/8 |
| 5,595,238 | 1/1997 | Mark et al. | 165/9 |
| 5,664,621 | 9/1997 | Brophy | 165/8 |
| 5,836,378 | 11/1998 | Brophy et al. | 165/9 |

FOREIGN PATENT DOCUMENTS

| | | |
|---|---|---|
| 147208 | 7/1952 | Australia . |
| 1200237 | 2/1986 | Canada . |
| 57-153198 | 9/1982 | Japan . |
| 58-18090 | 2/1983 | Japan . |
| 134983 | 4/1979 | United Kingdom . |
| 145792 | 1/1981 | United Kingdom . |

*Primary Examiner*—Christopher Atkinson
*Attorney, Agent, or Firm*—McDermott, Will & Emery

[57] ABSTRACT

A rotary heat regenerator wheel having an improved construction, including (a) spokes provided with a I-beam cross-section so as to provide greater strength and resistance to bending moments due to differential air pressure across the face areas of the wheel and a T-bar cross section for facilitating the insertion and removal of segments, and (b) at least two types of segments so as to facilitate insertion and removal of segments for maintenance and easy replacement.

8 Claims, 5 Drawing Sheets

ROTARY HEAT EXCHANGE WHEEL

RELATED APPLICATIONS

This application is a continuation-in-part of U.S. application Ser. No. 09/003237 filed Jan. 6, 1998 now abandoned.

BACKGROUND OF THE INVENTION

Regenerator heat exchange devices or regenerators are well known. One type of regenerator is the rotary air-to-air heat exchanger, which is typically in the form of a rotary heat exchange wheel including a matrix of heat exchange material. For example, see Canadian Patent No. 1,200,237 (Hoagland), U.S. Pat. Nos. 4,432,409 (Steele) and 4,875,520 (Steele et al.), and pending U.S. patent application Ser. No. 08/736,382, filed Oct. 24, 1996, filed in the names of Donald F. Steele and Lawrence C. Hoagland, entitled Regenerator Heat Exchanger Having One or More Adjustable Performance Characteristics and assigned to the present assignee (hereafter the "Co-pending Application"), which application is a continuation-in-part of Ser. No. 08/132,523 filed Oct. 6, 1993, now abandoned, all assigned to the present assignee and incorporated herein by reference. Rotary air-to-air heat exchangers transfer sensible heat and moisture, usually between ducted and counterflowing airstreams, for the purpose of conserving energy within a building, while providing outdoor air ventilation to remove air pollutants from a building. For example, heat and moisture from indoor air being exhausted to the outdoors during the heating season are transferred to the cooler, dryer incoming fresh air, and during the cooling season, heat and moisture from entering warm moist outdoor air are transferred to the cooler drier air as it is exhausted to the outdoors. Transfer of heat and moisture in this manner can typically reduce the amount of energy required to heat, cool, humidify or dehumidify the incoming ventilation air typically anywhere between about 50% and about 85%, depending primarily on the performance characteristics of the rotary energy transfer wheel.

It is well known to make such rotary heat exchange wheels with a matrix of heat exchange material (capable of absorbing sensible heat) coated with a desiccant material (capable of absorbing moisture and thus latent as well as sensible heat). Such regenerators are used in ventilation systems, such as provided in energy recovery ventilators or in heating and/or air conditioning systems, in which the transfer of both sensible and latent heat is desired as, for example, in the case of air conditioning systems used in summer climates characterized by hot and humid outdoor air. In such climates, it is often desirable to bring fresh air in from the outdoors. In this case the regenerators are used to transfer sensible and latent heat from incoming air to the outgoing air. The removal of latent heat from incoming air prior to passing the air over evaporation coils of an air conditioning system helps reduce the heat load imposed on the air conditioning system.

To achieve maximum latent heat transfer, as is well known in the prior art, a suitable sensible heat exchange matrix material such as plastic (i.e., high molecular weight, synthetic polymers), aluminum, or Kraft or other fibrous paper is completely and uniformly coated with a desiccant material in accordance with processes known to those skilled in the art. In one type of regenerator, the matrix comprises a plastic strip coated with a desiccant material wound around a hub so as to form a heat exchange wheel. The airflow through the wheel, and the efficiency of heat transfer by the wheel matrix, are determined in part by the spacing between opposing surfaces of adjacent portions of the strips of the matrix. This spacing can be controlled by controlling the height of embossments in the strip. For a given air flow, the tighter the spacing (or the denser the wrap), the higher the efficiency of heat exchange matrix and the greater the pressure drop across the two sides of the wheel. See U.S. Pat. Nos. 4,432,409 to Steele and 4,825,936 to Hoagland et al.

There has been a trend toward the requirement for increased ventilation rates to decrease indoor air pollutants. These larger ventilation rates necessarily require larger energy recovery wheels. As the wheels have increased in size, they have increased in weight so that it has become desirable to manufacture the wheel in wedge-shaped segments (typically eight segments, each subtending a 45° angle) and mount the segments in a wheel frame so that the wedge-shaped segments can each be separately mounted in the frame and removed for cleaning and/or replacement.

The wedge-shaped segments have worked well for wheels as large as 74 inches in diameter. However, wheels of even larger dimension are required, e.g., wheels having diameters on the order of 104 inches and larger. Increasing the wheel to this size creates problems. One problem relates to the wheel frame. The forces of the increased counterflowing air can provide bending moments to the larger wheel frame, which in turn can cause distortion of the wheel, as well as leaks around the periphery of the wheel. In addition, the increased weight of each wedge-shaped segment makes it relatively heavy and difficult to assemble in the wheel frame, and remove from the wheel frame for cleaning and replacement. For example, a wedge-shaped wheel segment made of plastic strips coated with a desiccant material, subtending a 45° angle, and designed for a 104 inch wheel would weigh on the order of 60 pounds or more depending on the thickness of the wheel. This is particularly a problem in the field, where commercial ventilation systems are typically mounted on the roofs of buildings making it difficult to service the wheels. In some designs it is necessary to remove the wheels with heavy equipment, making it often impractical to replace the wheel, and thus providing little incentive to do so.

Accordingly, the objects of the invention are to provide an improved rotary heat regenerator wheel assembly: (a) with an improved and stronger wheel frame assembly for supporting segments, (b) which is easy to assemble and disassemble, and (c) which includes differently shaped segments so that the segments can be of a reduced size to facilitate mounting and removing them from the frame, and cleaning and replacing them.

SUMMARY OF THE INVENTION

A regenerator heat exchange device comprises a frame, and a plurality of segments of an energy transfer material. In accordance with one aspect of the invention the frame includes a plurality of spokes, wherein each of the spokes includes at least a portion having an I-beam cross section for receiving at least an edge of one of the segments and for resisting the bending moment from forces of the counterflowing air.

Preferably, each of the spokes comprises (a) an I-beam portion having an I-beam cross section and a T-bar portion having a T-bar cross section, and (b) a bar constructed to secure segments in the frame.

In accordance with another aspect of the present invention, the matrix comprises a plurality of removable, interchangeable segments, wherein the segments include at least two types, each type having a different shape, so as to cooperate with one another so as to facilitate the assembly and removal of the segments from the frame.

In accordance with one embodiment the frame includes a plurality of spokes, and at least one of each of the types of segments is disposed between adjacent spokes.

In accordance with another embodiment each of the spokes is radially directed.

In accordance with yet another embodiment one of the types of segments, the inner radial segment, is shaped and sized to slide radial into and out of place when mounting the segment between spokes, the segment fitting between the I-beam portions of two adjacent spokes at a radial inside position, and the other one of the types of segments is shaped and sized to move axially into and out of place and fit between the T-bar portions of two adjacent spokes in a radial outside position so as to facilitate the mounting and removal of segments in the field, without the need to completely remove the wheel from the ventilation system to which it is mounted.

In accordance with another aspect of the present invention, each of the spokes includes a I-beam cross-section having a web portion and a flange portion on each side of the web portion and adapted to carry a significant amount of the bending stresses placed on the wheel from the forces placed on the wheel by the counterflowing air streams. At least some of the segments are shaped and sized to fit between the flange portions of each spoke and between the web portions between adjacent spokes when properly positioned in the wheel frame.

In accordance with yet another embodiment, each spoke includes an inner spoke portion having an inner I-beam portion for radially receiving and securing an inner segment, and an outer T-bar portion for axially receiving the outer segment so as to lock the inner radially positioned segment in place, and a bar for locking the outer radially positioned segment in place.

Still other objects and advantages of the present invention will become readily apparent to those skilled in this art from the following detailed description wherein a preferred embodiment is shown and described, simply by way of illustration of the best mode of the invention. As will be realized, the invention is capable of other and different embodiments, and its several details are capable of modifications in various respects, all without departing from the invention. Accordingly, the drawings and description are to be regarded as illustrative in nature, and not restrictive.

BRIEF DESCRIPTION OF THE DRAWINGS

For a fuller understanding of the nature and objects of the present invention, reference should be had to the following drawings, wherein.

DETAILED DESCRIPTION OF THE DRAWINGS

Figure 1:
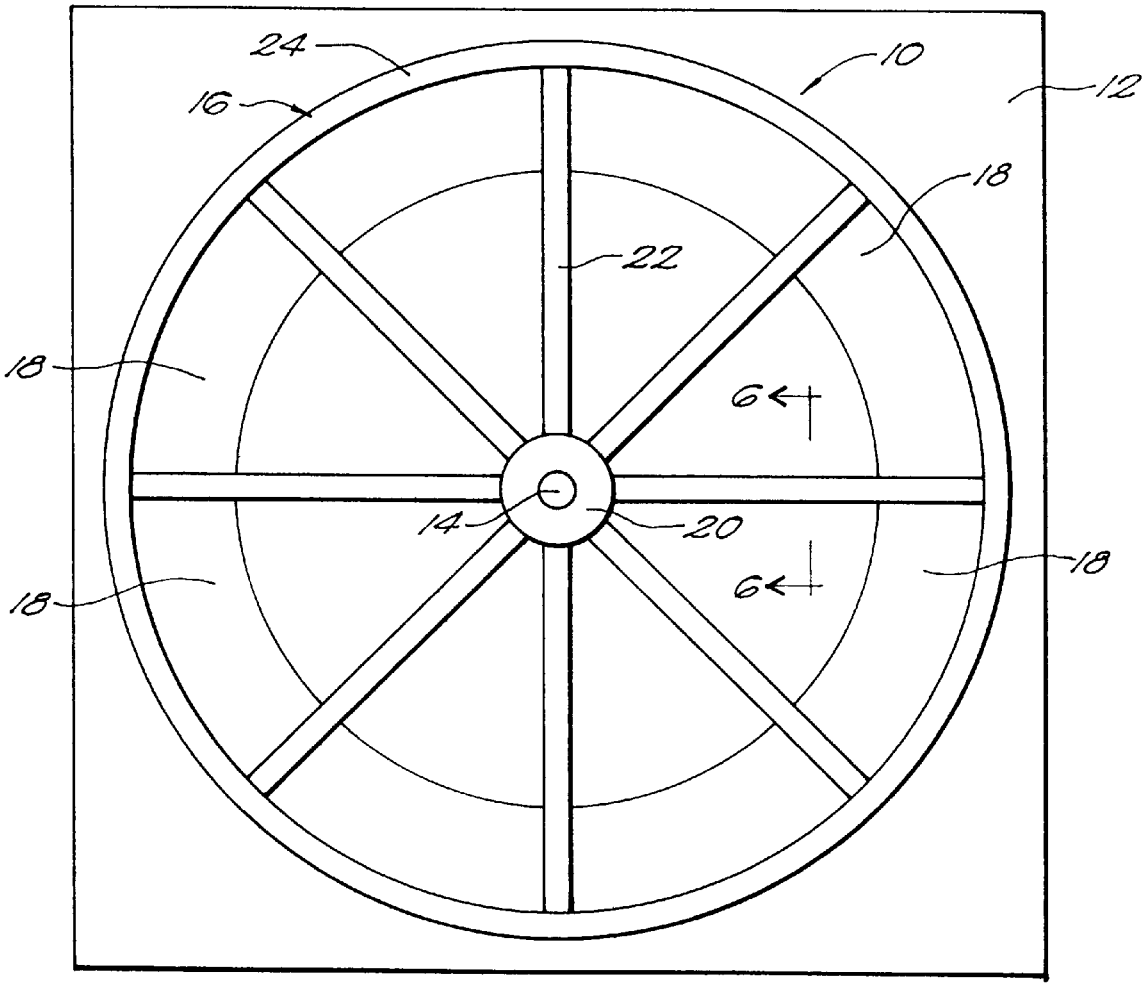
FIG. 1 is a front view of a preferred embodiment of a rotary heat exchange wheel, positioned within a rotary heat exchange system, the wheel comprising a matrix made with removable segments in accordance with the present invention.

In FIG. 1, the regenerator of the present invention is preferably in the form of an energy recovery wheel 10 supported within a housing 12, the wheel being adapted to be mounted in the path of two counterflowing ducted airstreams, so that at any one instant of time, one airstream flows through one half of the wheel, and the other through the other half of the wheel. The wheel is mounted for rotation about its axis 14 so that heat is transferred from the warmer airstream to the cooler airstream.

The wheel comprises a supporting frame 16 and energy transfer segments 18 of a heat exchange material. The frame is constructed to withstand the bending moments of counterflowing air streams, while also providing a strong construction for retaining and easily removing energy transfer segments from the frame.

Figure 2:
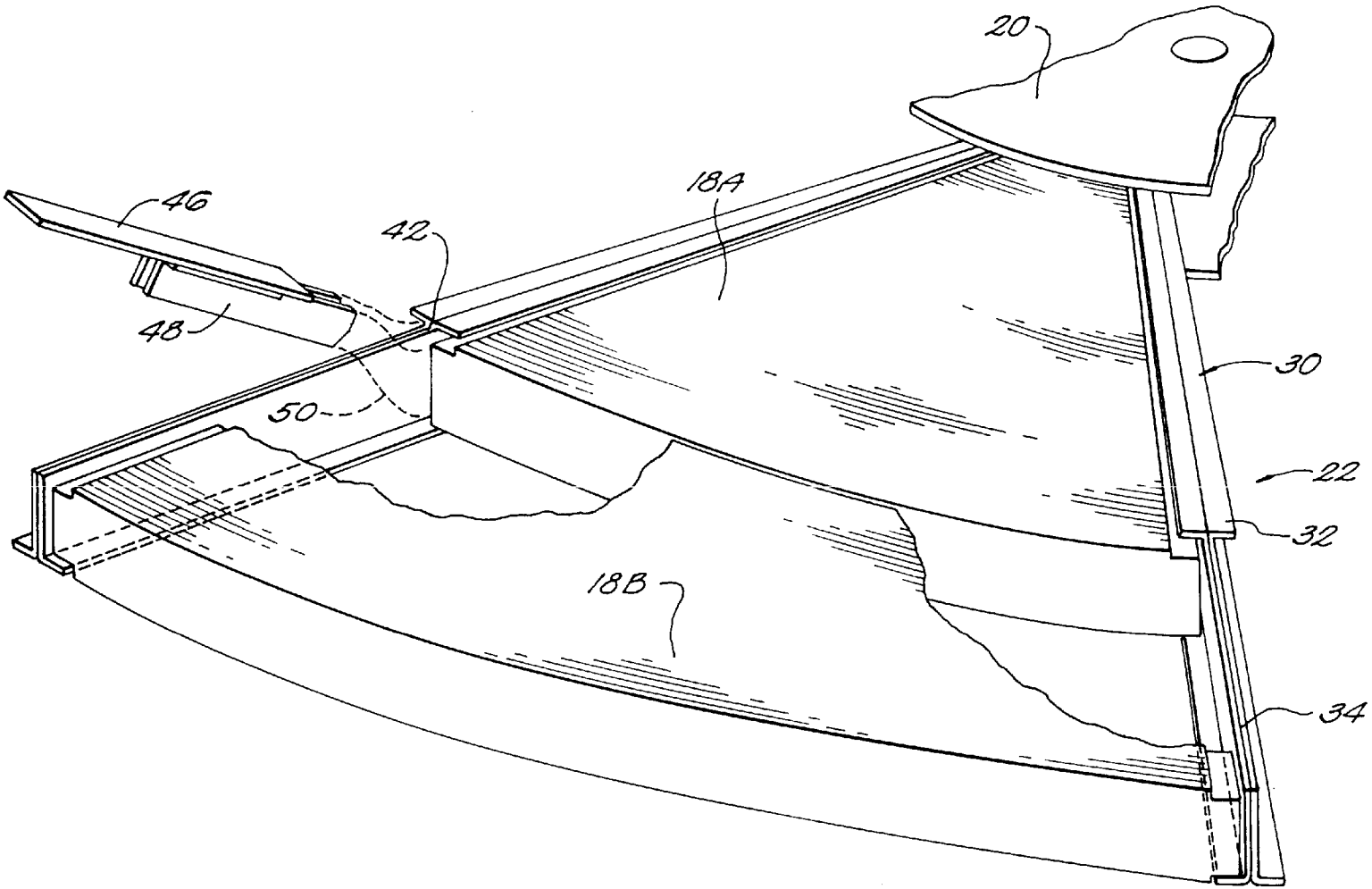
FIG. 2 is a perspective view of a portion of the wheel of FIG. 1.
Figure 3:
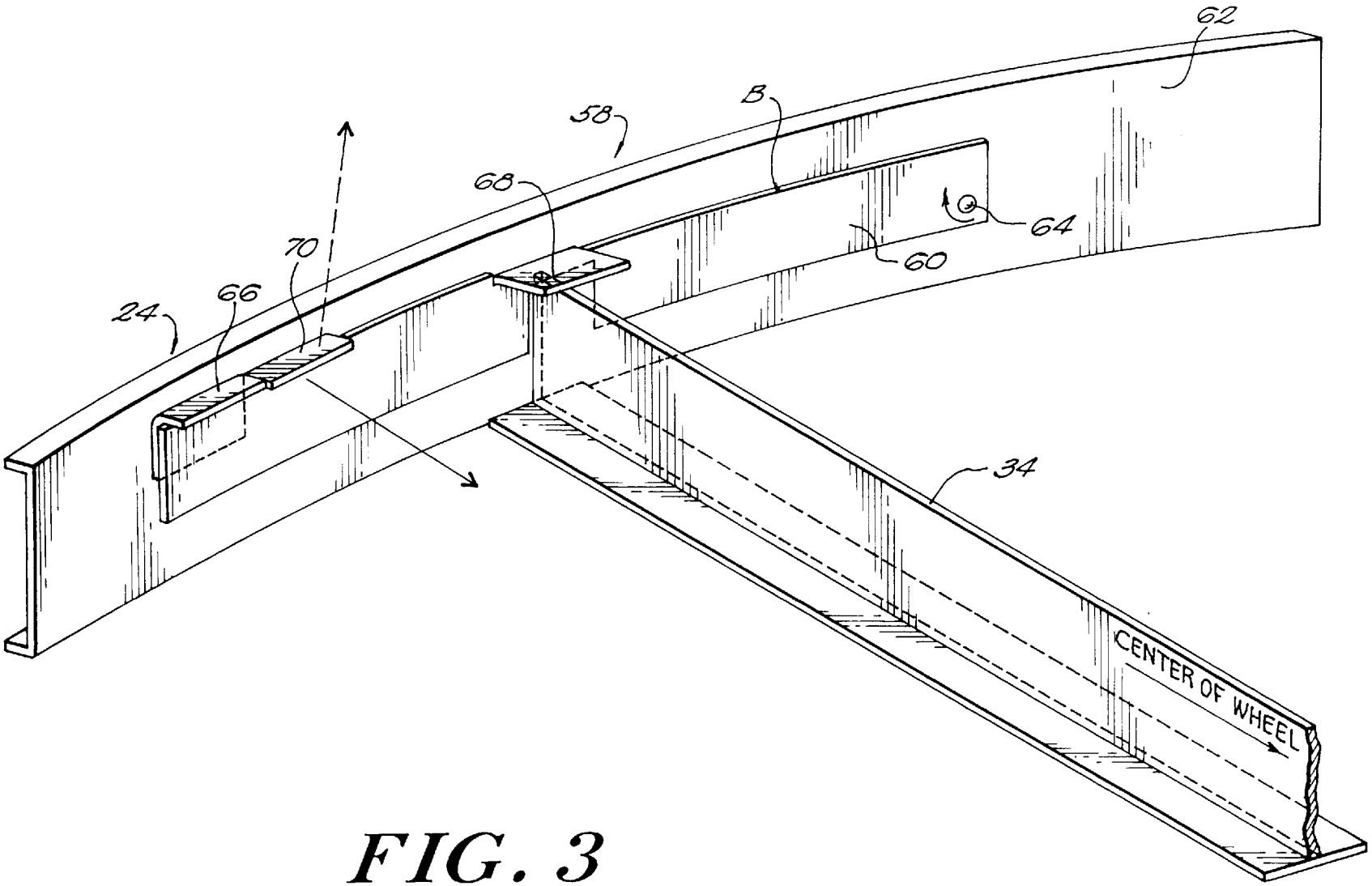
FIGS. 3 and 4 are perspective views of a part of the wheel of FIG. 1 showing the mechanism for securing and removing the outer radial segments from the wheel frame.
Figure 4:
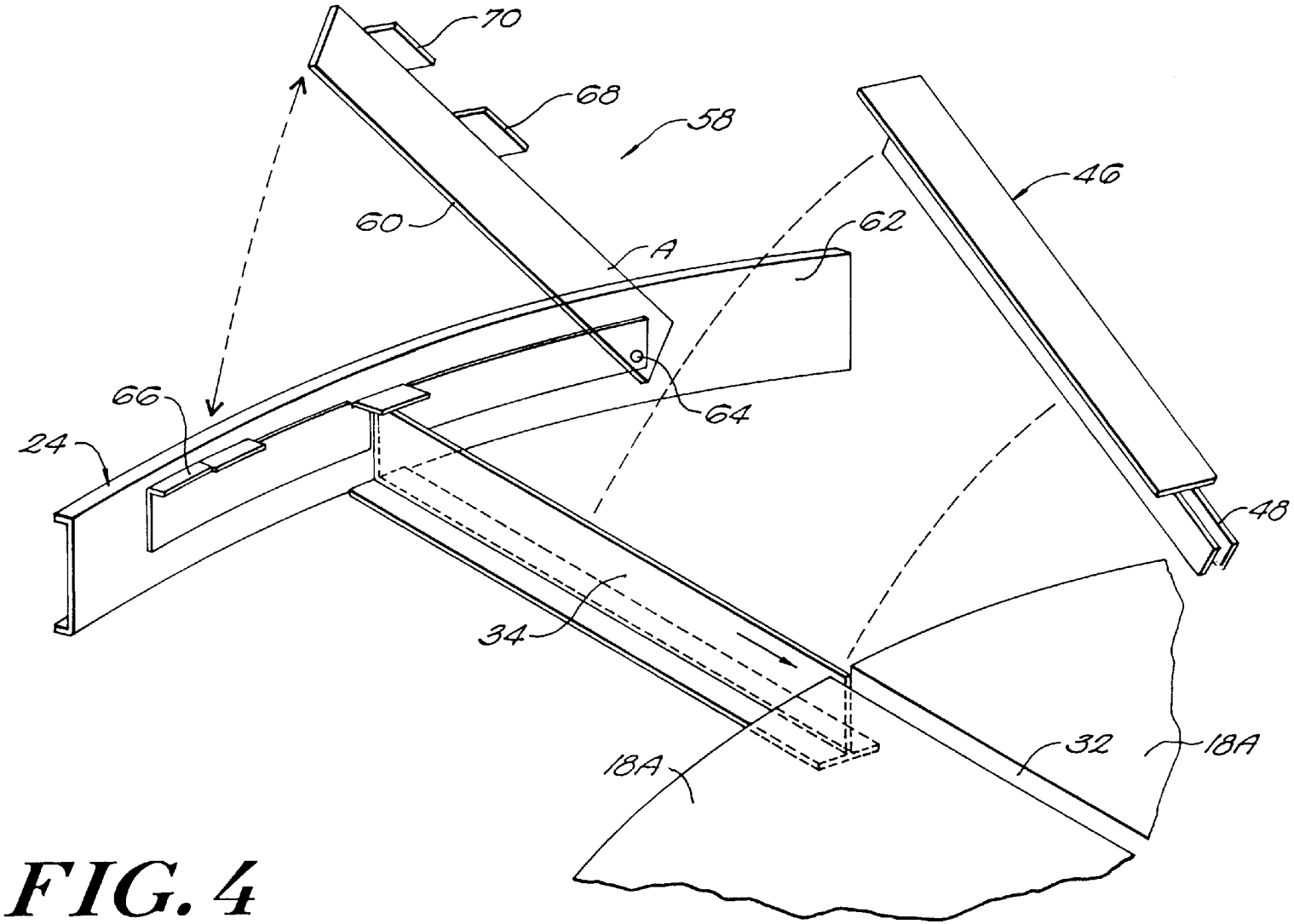
Figure 5:
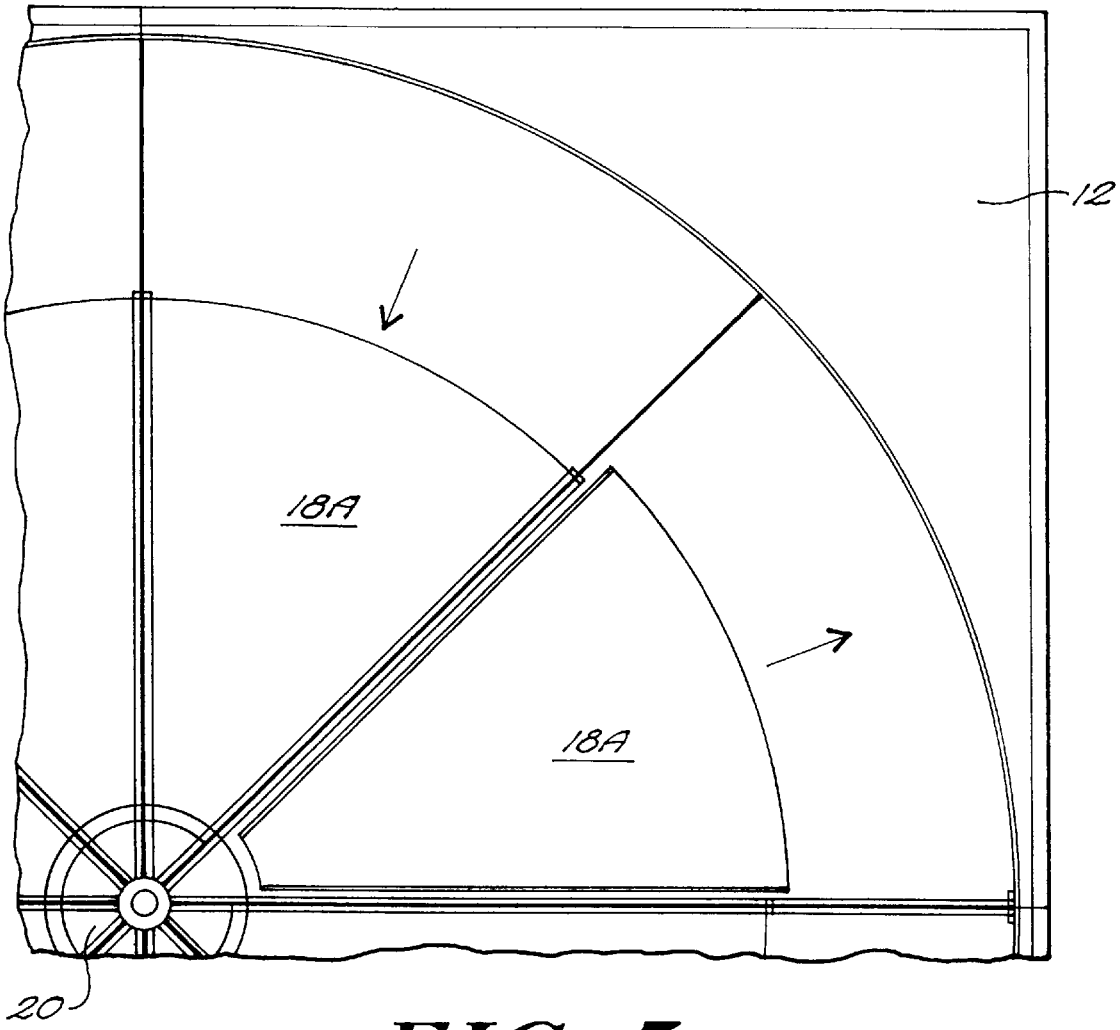
FIG. 5 is a front view of a portion of a wheel illustrating the mounting and removal of an inner radial segment from the wheel frame.

As shown in FIG. 1, and greater detail in FIGS. 2–5, the supporting frame 16 of energy recovery wheel 10 comprises a hub section 20 (shown in FIGS. 1, 2 and 5), spokes 22 (shown in FIGS. 2–5) and a rim assembly 24 (best shown in FIGS. 3 and 4) for supporting the energy transfer segments 18 (shown in detail in FIGS. 2 and 5). The frame 16 of the wheel 10 is preferably made of a light weight, sturdy material, such as aluminum or steel. The frame includes a plurality of spokes 22, preferably although not necessarily extending radially from the hub section 20 to the rim assembly 24, equiangularly around the hub section. For example, eight spokes spaced 45° apart can be provided, although the number and angle can vary. The spokes can also extend at an angle to the radial direction.

Figure 6:
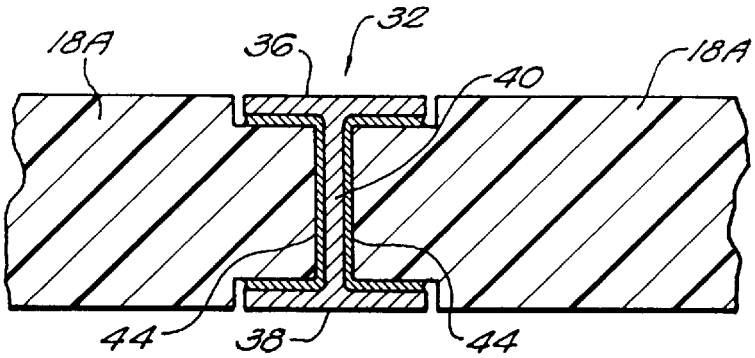
FIG. 6 is a cross-sectional view taken along line 6—6 in FIG. 1.

As best shown in FIGS. 2–4, each spoke 22 includes an elongated spoke element 30 preferably having an inner I-beam portion 32 attached to the hub section 20, and an outer T-bar portion 34 extending from the I-beam portion 32 to the rim assembly 24. As best seen in FIG. 6, the I-beam portion 32 includes a pair of flanges 36 and 38 with an intermediate web 40. The T-bar portion 34 is essentially an extension of one flange and the web of the I-beam portion so that the I-beam portion and T-bar portion is preferably an, integrated, unitary construction, although the T-bar portion can be made separately from the I-beam portion and the two secured together to form a each spoke. The inner I-beam portion extends a predetermined distance from the center of the wheel where it terminates at point 42 (see FIG. 2), while the T-bar portion 34 extends from the termination point 42 of the I-beam to the outer rim assembly 24 of the frame 16.

With this configuration, two differently shaped energy transfer segments 18A and 18B can be utilized, thus providing smaller segments facilitating assembly, removal, replacement and/or cleaning of the segments. The inner segment is wedge-shaped, and is similar to the prior art segments described, for example, in the Co-pending Application. When properly positioned in the frame, the inner segment preferably has an inner arcuate edge having a radius of curvature so as to cooperate with the hub section, and an outer arcuate edge having a radius of curvature that extends exact to the termination point 42, or a predetermined distance (e.g., a fraction of an inch) beyond the termination point 42 so that a portion of the inner segment extends into the T-bar portion 34 of the two adjacent spoke elements 22. The outer energy transfer segment 18B is an arcuate shaped segment and when properly positioned in the frame, has an inner radius of curvature substantially the same as the outer radius of curvature of the inner segment, and an outer radius of curvature substantially the same as the outer rim assembly. Thus, the outer segment 18B is adapted to fit between the inner segment 18A and the rim assembly 24, and in the T-bar portions 34 of the adjacent spoke elements.

The energy transfer segments 18A and 18B can be formed from strips of plastic (e.g., high molecular weight, synthetic polymers), aluminum, Kraft or other fibrous paper, or steel. Any polymers of a type capable of being heat sealed is preferably used. Each of the inner and outer radially positioned segments can be formed, for example, by cutting completely through one or more strips which are wound into a wheel and subsequently cut, for example, with a heated tool from one face to the opposite face so that the resulting wedge-shaped or arcuate-shaped elements each have arc-shaped strips fused at their ends along the cut line. As shown in FIG. 6, both the inner and outer segments can be framed with a suitable frame, such as a c-channel bracket indicated generally at 44 sized so as to fit within with the I-beam construction formed by the spoke element 30. Alternatively, the c-channel bracket can be omitted.

Those skilled in the art will recognize that other matrix construction techniques may be employed, and matrices of other configurations, such as those containing flat layers, or a honeycomb structure, may be produced. As is known in the art, suitable spacing means are provided in the matrix so as to form gas passageways in an axial direction through the wheel segments at a given surface area density.

As shown in FIG. 5, the inner pie-shaped segment thus can be positioned between the spokes and spaced from the hub section, and radially slid into position against the hub section. In position the inner segment will be secured between the flanges of the two adjacent I-beam portions of the adjacent spoke elements, and extend at its outer radial edge, to or a short distance past the end of the I-beam flange where the T-bar starts at the termination point 42. Once the inner segment is in position, the outer segment can be axially slid into place between the rim assembly 24 and the inner segment and between the T-bar portions 34 of the adjacent spoke elements securing the inner segment in place.

In order to secure the outer segments within the frame assembly, as seen in FIG. 2 a bar 46 is provided. The bar 46 preferably locks or clamps the straight edge of the outer segment so as to secure the outer segment in place. The bar 46 can be secured in any known manner. Preferably, the bar includes means for attaching the bar so that it covers the T-bar portion. The bar preferably includes a pair of strips or tabs 48 that are adapted to extend (as indicated in FIG. 2 by dotted lines 50) into the I-beam portion of the spoke element between the straight edge of the inner segment and the web of the I-beam portion, and fit over at least a portion of the web 40 of the T-bar portion 34 and the straight edge of the outer energy transfer segment 18B on the opposite sides of the spoke.

The rim assembly preferably includes a suitable retainer, such as the mechanism 58 shown in FIGS. 3 and 4, for retaining the bar 46 in place. The mechanism 58 preferably includes a pivotal arm 60 attached to the inside of the outer rim 62, which pivots about the pivot pin 64 between an open position (seen in position A in FIG. 4) and a closed, clamping position (seen in position B in FIG. 3) wherein the arm 60 is held in place by the catch 66 provided on the inner periphery of the outer rim 62. The arm 60 is provided with two tabs 68 and 70. Tab 68 is adapted to fit over the outer end of the bar 46 when the arm is moved to the closed position so as to secure the bar 46 in place. The other tab 70 provides the means for moving the arm radially inward so that it can clear the catch 66 when moving the arm between the closed position to an open position.

It should be appreciated that bar 46 can be attached to the frame in other ways. For example, the bar 46 can be secured to spoke with one or more fasteners, such as screws and/or bolts. The bar can be provided with clips that attach to the web of the T-bar portion. In addition, the bar is shown as extending the length of the T-bar portion, but alternatively could be of other lengths, as for example extending further over the I-beam portion, or be shortened to cover only a portion of the T-bar portion.

It should be noted that the face area of the wheel through which air can flow is an important factor affecting pressure drop and efficiency of energy transfer within a given wheel radius. In the present illustrated design, the face area of the wheel is reduced by both the width of the I-beam portion of the spoke element 30, and the segment frame 44. In a typical wheel design, eight I-beam spokes can represent as much as 5% of the total surface area of a wheel, as can the frames 44 of eight wedge shaped segments. By nesting the frames 44 of the segments within the I-beam construction, flow through area of the wheel will not be appreciably affected.

It should be appreciated that using the I-beam construction provides a light weight and inexpensive construction for resisting the bending moments caused by the counterflowing air streams. Using an I-beam construction, a high proportion of material is located in the parallel flanges at the extremities of the beam where maximum bending forces of compression and tension occur. Although ideal for reasons of strength, the parallel flanges (alternate compression and tension members of the I beam) occupy face area of the wheel through which air could otherwise flow, although by nesting the brackets of the segments within the I-beam construction, the disadvantage is minimized. Further, by using the inner and outer segments, smaller and lighter segments are provided facilitating the assembly and removal of the segments. By making the faces of the inner and outer segments of substantially the same surface area (the surface area normal to the flow of air), they will weigh approximately the same and be one-half the size of a single wedge unit of comparable size designed for the same sized wheel. The parts provide a convenient way of assembling and disassembling the inner and outer radial segments not afforded by a unitary I-shaped cross-section spoke construction. This is extremely important in view of the size of the wheels currently being manufactured, where the segments weigh on the order of 30 pounds each. In addition, it is well known that an I-beam construction provides extremely strong support against bending stresses, to which the wheel will be subjected as the wheel rotates in two counterflowing airstreams. A unitary T-bar construction does not provide the support provided by a unitary I-beam construction. However, Applicants have determined that most of the bending stress is concentrated on the inner radial segment, and thus provided on the I-shaped cross section of the inner spoke section. This allows for the outer spoke section to be of a T-shaped cross section, and creates the ability to provided thinner (and thus lighter) matrixes, despite the size of the wheel. It is important to note that when the bar clamps the edge of each of two outer segments in the frame, the resulting structure of the T-shaped cross section and bar will not provide the support of an I-beam construction, nor does it need to. The clamping bar provides little additional support to bending stresses Other alternative structures can be provided. For example, the inner segments can be made smaller or larger than the outer segments. In addition, while the preferred arrangement is to provide an inner I-beam portion, and the outer T-bar portion, under certain circumstances where it is determined for example that most of the bending stresses are carried by the outer segment, due for example to the difference in sizes between the inner and outer segments, the T-bar portion can be provided as the inner portion and the I-beam portion as the outer portion. In this latter case the outer segment would first be inserted radially into the I-beam portions of the spokes, and then the inner segments would be inserted axially into the T-bar portions of the spokes. In this case a bar or other suitable device would secure the inner segment in place. In addition, while two different segments have been shown and described, the wheel can include more than two types of different types of segments.

In this disclosure, there are shown and described various preferred embodiments of the invention, but as aforementioned, it is to be understood that the invention is capable of use in various other conditions and environments and is capable of changes or modifications within the scope of the inventive concept as expressed herein.

What is claimed is:

1. A regenerator heat exchange device comprising:

a rotatable frame having a rotation axis; and an energy transfer matrix comprising a plurality of removable, interchangeable heat exchange segments, said segments including at least two types, one type sized to provide an inner segment and the other type sized to provide an outer segment, the two types being shaped so as to cooperate with one another in said frame;

wherein the frame includes:

(a) a hub section;

(b) a plurality of spokes extending from said hub section, each spoke having (i) a first spoke section having an I-beam cross-section adapted to receive on each side of the first spoke section an edge of a first of said types of segments as the segment is moved radially with respect to the axis of the frame so as to lock the segment in said frame, and (ii) a second spoke section having a T-bar cross section adapted to receive on each side of the second spoke section an edge of a second of said types of segments as the segment is moved axially with respect to the axis of the frame;

(c) a rim assembly coupled to the plurality of spokes; and (d) a plurality of bars, constructed and arranged so as to secure the edge of adjacent ones of the second types of segments in the frame.

2. A regenerator heat exchange device according to claim 1, further including a retainer for securing each bar in place.

3. A regenerator heat exchange device according to claim 2, wherein the retainer is attached to the rim assembly, and pivotal so as to clamp each bar in place.

4. A regenerator heat exchange device according to claim 1, wherein each bar includes a mechanism for locking one end of the bar to the first spoke section.

5. A regenerator heat exchange device according to claim 1, wherein each bar includes a pair of tabs for insertion into opposite sides of the corresponding first spoke section so that each tab is locked between the first spoke section and the opposing portion of the edge of the corresponding one of the first type of segment.

6. A regenerator heat exchange device according to claim 1, wherein each of said spokes is radially directed.

7. A regenerator heat exchange device according to claim 1, wherein the first spoke section in an inner section of each spoke, and the second spoke section is an outer section of each spoke.

8. A method of assembling a regenerator heat exchange wheel including:

(A) a rotatable frame comprising (a) a hub section; (b) a plurality of spokes extending from said hub section, each spoke having (I) a first spoke section having an I-beam cross-section, and (ii) a second spoke section having a T-bar cross section; (c) a rim assembly; and (d) a plurality of bars; and (B) an energy transfer matrix comprising a plurality of removable, interchangeable segments, said segments including at least two types, one type sized to provide an inner segment and the other type sized to provide an outer segment, the method comprising:

receiving on each side of the first spoke section an edge of a first of said types of segments as the segment is moved in a plane substantially normal to the axis of the frame so as to lock the segment in the frame;

receiving on each side of the second spoke sections an edge of a second of said types of segments as the segment is moved in a direction substantially parallel to the axis of the frame; and using each bar to secure the second types of segments in said frame.

* * * * *